United States Patent [19]

Drake

[11] Patent Number: 4,825,673

[45] Date of Patent: May 2, 1989

[54] MOISTURE PROTECTION DEVICE FOR KEY LOCK OPENINGS

[76] Inventor: William T. Drake, Pleasant Manor Apts., Apt. 12-A, Pleasantville, N.J. 08232

[21] Appl. No.: 225,360

[22] Filed: Jul. 28, 1988

[51] Int. Cl.[4] ..... E05B 17/18

[52] U.S. Cl. ..... 70/455

[58] Field of Search ..... 70/455, 54, 55, 423, 70/424; 292/DIG. 2, 251.5; 150/52.9, 52.10

[56] References Cited

U.S. PATENT DOCUMENTS

| | | | |
|---|---|---|---|
| 1,982,956 | 12/1934 | Jacobi | 70/46 |
| 2,217,730 | 10/1940 | Cooley | 70/455 |
| 3,421,350 | 1/1969 | Shanok et al. | 70/455 |
| 3,434,318 | 3/1969 | Thiry | 70/455 |
| 3,583,185 | 6/1971 | Jacobi | 70/455 |
| 3,740,981 | 6/1973 | Patriquin | 70/455 |
| 3,861,182 | 1/1975 | Skinner | 70/455 |
| 4,090,379 | 5/1978 | Lehner | 70/455 |
| 4,262,508 | 4/1981 | Davidson | 70/455 |

FOREIGN PATENT DOCUMENTS

| | | | |
|---|---|---|---|
| 1902467 | 10/1970 | Fed. Rep. of Germany | 70/455 |
| 3509684 | 10/1986 | Fed. Rep. of Germany | 70/455 |
| 588032 | 1/1925 | France . | |
| 226025 | 4/1969 | Sweden . | |

*Primary Examiner*—Robert L. Wolfe

*Attorney, Agent, or Firm*—Thomas A. Lennox

[57] ABSTRACT

A device for attachment to and protection of the key lock opening mechanisms on motor vehicles including an integral molding of flexible rubber having on one end a base section adhesively attached to the exterior surface of the motor vehicle and the other end a magnet positioned to attach to the exterior surface urging an intermediate flexible rubber frame around the key lock mechanism with a flexible connnecting section between the frame and the base section with sufficient memory to reseal the device over the lock mechanism.

16 Claims, 2 Drawing Sheets

MOISTURE PROTECTION DEVICE FOR KEY LOCK OPENINGS

BACKGROUND OF THE INVENTION

This invention involves a moisture and freeze protection device to cover key lock opening mechanisms located on the exterior surface of motor vehicles.

Many of the lock opening devices on the doors or trunks of automobiles are not protected from moisture intrusion. While some devices, generally supplied as original equipment, have been provided with hinged mechanisms to protect the key opening from moisture, most of the key lock openings are exposed to the weather. In certain climates, there is a great deal of moisture in the form of rain or fog prior to freezing temperatures. This combination can cause the mechanism to freeze in the locked position preventing entry into the motor vehicle. In addition to the metal hinged covers provided to cover the locks, rubber sleeves have been provided to interfit over the handle and key opening combination. Sheets of plastic material attached with magnetic strips as well as a magnetic ring attached with a chain have been used to protect the key opening. None of these devices have satisfactorily satisfied the general need described above nor have they attained the objects described hereinbelow.

SUMMARY OF THE INVENTION

It is an object of the present invention to provide a device which seals moisture out of the key lock opening on motor vehicles.

It is a further object of the present invention to provide a device to cover key lock openings which may be attached directly to the outside surface of the motor vehicle proximate the key lock opening.

It is an additional object of the present invention to provide a protecting device for key lock openings that may be attached above or on either side of the key lock opening.

It is an additional object of the present invention to provide a protection device for key lock openings which virtually recloses itself automatically.

It is a further object of the present invention to provide a protection device for key lock openings which provides a sealing surface of flexible elastomeric material utilizing a magnetic sealing force.

It is an additional object of the present invention to provide a protection device for key lock openings which is versatile in size and positioning to interfit over the vast majority of models.

It is a particular object of the present invention to provide a protection device that is easily permanently mounted, is easily opened to expose the key lock opening, and is easily closed to cover and protect the opening.

The invention is a moisture and freeze protecting device to cover key lock opening mechanisms proximate to an exterior surface of motor vehicles. The device includes an integral molding of flexible, preferably elastomeric, polymeric material. The molding includes a base portion having a bottom surface opposed to the exterior surface of the motor vehicle and a flexible connecting section connected at one end and extending from the base portion toward the key lock opening. The molding further includes a panel section of a sufficient size and shape to cover the key lock opening device, the section being connected to a free end of the connecting section. Finally, the molding includes a continuous frame member of a size and shape to surround the key lock opening mechanism, the frame member depending from the panel section toward and terminating at a sealing surface abutting the exterior surface. The device further includes an adhesive means adhesively attaching the bottom surface of the base portion to the exterior surface to the vehicle, and a magnet attached to the molding, the magnet being positioned and of a size and shape that a metal attracting surface of the magnet magnetically attaches to the exterior surface and urges the sealing surface against the exterior surface. It is preferred that the molding also include an extension of the panel member generally parallel to the sealing surface to which the magnet is attached. It is further preferred that the extension project from the panel section in a direction away from the base portion. It is preferred that the frame member be annular in shape or that the frame member be square in shape. It is preferred that the connecting section be made highly flexible by a reduced thickness. A preferred device has the molding be of a rubber composition, more preferably a neoprene rubber composition. A preferred adhesive means is a double-sided contact adhesive composition.

The invention is also a moisture and freeze protecting device to cover key lock opening mechanism proximate to an exterior surface of motor vehicles including an integral molding of flexible polymeric material. The molding includes a base portion having a bottom surface opposed to the exterior surface of the motor vehicle and a flexible connecting section connected at open end and extending from the base portion toward the key lock opening. The molding also includes a panel section of a sufficient size and shape to cover the key lock opening device, the section being connected to a free end of the connecting section and a continuous frame member of a size and shape to surround the key lock opening mechanism, the frame member depending from the panel section toward and terminating at a sealing surface abutting the exterior surface, the sealing surface being a sufficient height from the panel section that when the sealing section abuts the exterior surface, the panel does not touch or barely touches the key opening mechanism. The molding also includes an extension of the panel member parallel to the sealing surface. The device includes an adhesive means adhesively attaching the bottom surface of the base portion to the exterior surface to the vehicle, and a magnet attached to the extension of the panel member, the magnet being of a size and shape that a metal attracting surface of the magnet is alignable with and attaches to the exterior surface and urges the sealing surface against the exterior surface.

DESCRIPTION OF PREFERRED EMBODIMENTS

Figure 1:
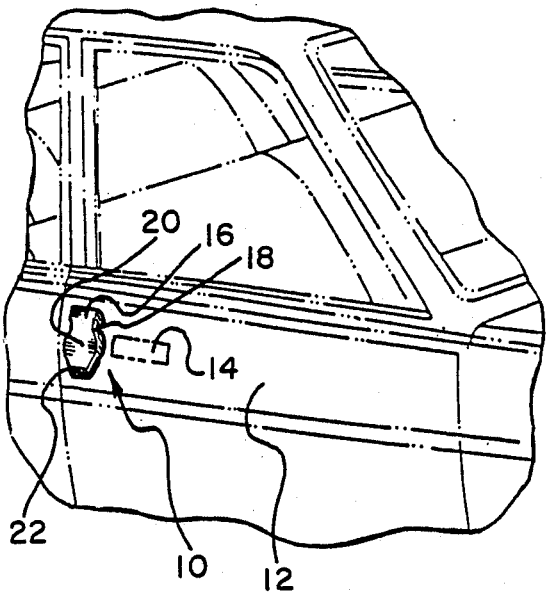
FIG. 1 is a perspective view of a protection device of the present invention covering a key lock opening on the outside of a door panel.
Figure 2:
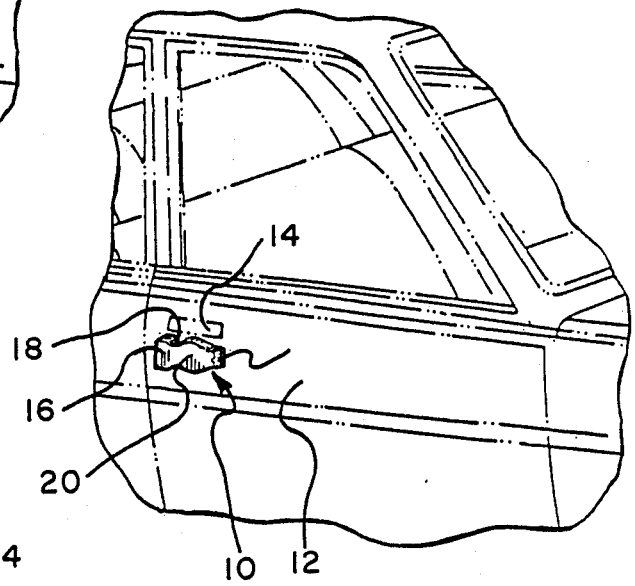
FIG. 2 is a perspective view illustrating the protection device illustrated in FIG. 1 positioned differently on the outside of a door panel covering a key lock opening.
Figure 3:
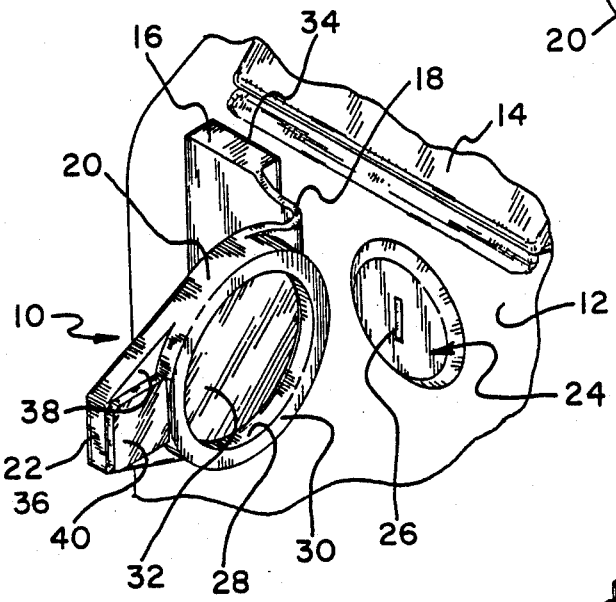
FIG. 3 is an expanded perspective view of the protection device illustrated in FIGS. 1 and 2 pulled back to expose the key lock opening.
Figure 4:
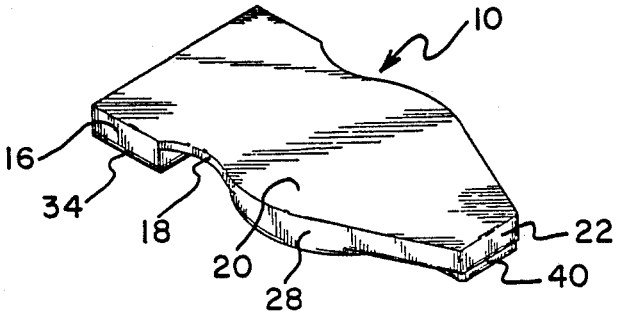
FIG. 4 is a perspective view of the outside of the protection device illustrated in FIG. 1.
Figure 5:
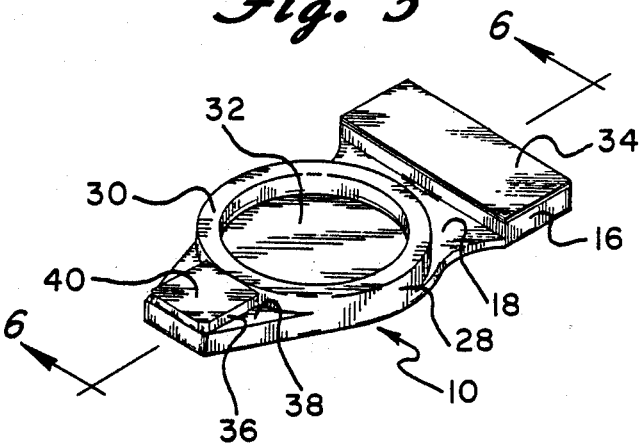
FIG. 5 is an underside perspective view of the protection device illustrated in FIG. 1.
Figure 6:
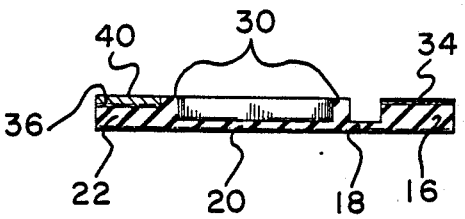
FIG. 6 is a cross-sectional view taken along lines 6—6 of FIG. 5.

In FIG. 1, protecting device 10 is shown attached to door surface 12 covering a key lock opening positioned to the side of door handle 14 (which is hidden in this view). Protecting device 10 includes an integral molding of rubber material, such as neoprene rubber, silicone rubber or like material. The molding may have a pattern on the outside surface and may include indicia to identify the particular type of motor vehicle, the supplier of the object or a personalized message. It may be supplied in any color chosen for outdoor durability. The integral molding includes base portion 16, flexible connecting section 18, panel section 20, extension 22 and a frame member section hidden in this view. As illustrated in FIG. 1, protecting device 10 is shown attached such that base portion is attached above the key lock opening with the integral molding extending downwardly with terminal extension 22 positioned below the key lock opening. This is the preferred configuration of attachment although one of the advantages of this device is that it may be attached at any angle. For example, in FIGS. 2 and 3, protection device 10 is shown attached in a horizontal position with base section 16 to the left and extension 22 to the right. This attachment configuration would be handy for a right handed person who could easily lift up the portion of the device with the left hand, bending it to the left as illustrated in FIG. 3 exposing key lock opening device 24 with key opening 26. The person can then easily insert the key with the right hand into the lock while holding device 10 in its open position. In the alternative, device 10 may be attached in the opposite direction to that illustrated in FIGS. 2 and 3 such that base portion 16 is positioned to the right of key lock opening device 24 with the balance of device 10 extending over the key lock opening positioning extension 22 on the left side of opening 26. In this configuration, it is easy for a left handed person to open device 10 pulling it to the right of key opening 26 and inserting the key with the left hand. The underside of device 10 is illustrated in FIG. 3 showing annular frame 28 as the final part of the integral molding. Thus, frame 28 as well as all of the rest of the integral molding is flexible rubber. Ring frame 28 terminates at sealing surface 30 which is flat so as to tightly seal against surface 12 around key lock opening mechanism 24. Bottom surface 32 of panel section 20 is a sufficient distance from surface 30 such that key lock mechanism 24 does not touch or barely touches surface 32. In that way, the tightest possible seal may be attained. The thickness of connecting section 28 is about 1/32 inch thick with neoprene rubber modules to provide flexibility with sufficient memory that sealing surface 30 of device 10 tends to reseat itself and reseal around lock device 24 after use. Bottom surface 34 of base portion 16 is adhesively attached to surface 22 using double sided contact adhesive tape. Magnet 36 is adhesively attached to underside surface 38 of extension 22. The thickness combination of extension 22 and the magnet 36 is chosen to position magnet surface 40 in substantially the same plane as surface 30. Thus, as frame 28 nears key lock mechanism 24 either by pushing with the hand or by memory of the rubber, magnetic surface 40 is magnetically attracted by metal surface 12 and attaches thereon urging surface 30 against surface 12 to seal around key lock mechanism 24. FIGS. 4 and 5 illustrate protecting device 10 of different angles to show the shape of the elements described hereinabove. Double sided tape 34 is illustrated as supplied with a paper protection piece over the adhesive which is removed prior to attachment to the motor vehicle exterior surface. FIG. 6 illustrates the relative thicknesses of the sections of the integral molding.

Figure 7:
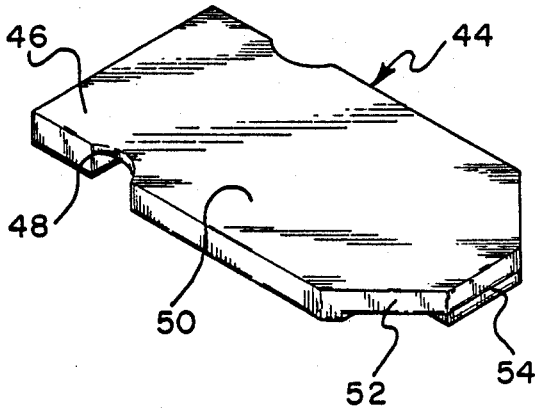
FIG. 7 is a top perspective view of an alternative embodiment of a protection device of the present invention.
Figure 8:
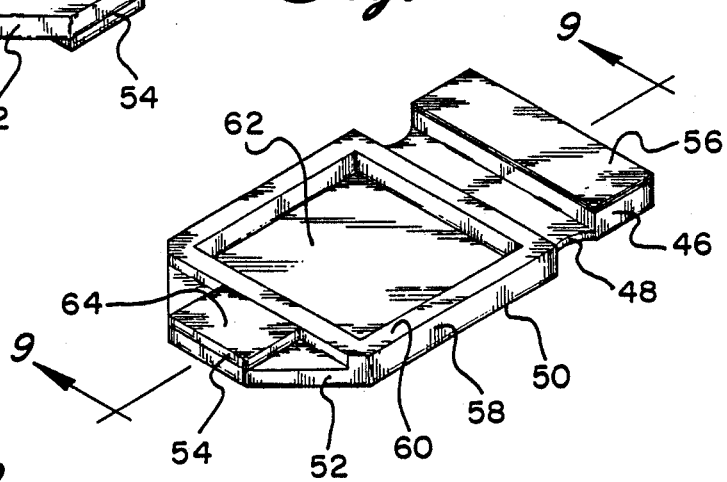
FIG. 8 is a bottom perspective view of the protection device illustrated in FIG. 7.
Figure 9:
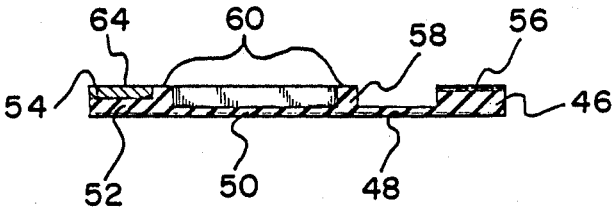
FiG. 9 is a cross-sectional view taken along lines 9—9 of FIG. 8.

FIG. 7 is a perspective view of an alternative embodiment of the present invention. The same elements of device 10 are present in protection device 44 which again includes an integral molding of base section 46, thin connecting section 48, panel section 50, extension section 52 and frame 58, hidden in this view. Magnet 54 is attached to the bottom surface of extension 52. In the bottom perspective view of FIG. 8, double sided tape combination and paper protection sheet 56 are adhered to the bottom surface of base section 46. Square shaped frame 58 terminates in sealing surface 60 which is sufficiently far enough distance from bottom surface 62 of panel section 50 to interfit over and cover a wide variety of key lock mechanisms. Magnet 54 is attached to the bottom surface of extension 52 placing magnetic attracting surface 64 in the essentially the same plane as sealing surface 60 to urge that surface around the key lock opening and seal against the exterior surface of a motor vehicle around the key lock opening mechanism.

While this invention has been described with reference to the specific embodiments disclosed herein, it is not confined to the details set forth and the patent is intended to include modifications and changes which may come within and extend from the following claims.

I claim:

1. A moisture and freeze protecting device to cover key lock opening devices proximate to an exterior surface of motor vehicles comprising:

(a) an integral molding of flexible polymeric material, the molding comprising:
  (i) a base portion having a bottom surface opposed to the exterior surface of the motor vehicle,
  (ii) a flexible connecting section connected at one end and extending from the base portion toward the key lock opening,
  (iii) a panel section of a sufficient size and shape to cover the key lock opening device, the section being connected to a free end of the connecting section,
  (iv) a continuous frame member of a size and shape to surround the key lock opening device, the frame member depending from the panel section toward and terminating at a sealing surface abutting the exterior surface, and
  (v) an extension of the panel member having a bottom surface opposed to the external surface of the motor vehicle that is parallel to the sealing surface, (b) an adhesive means adhesively attaching the bottom surface of the base portion to the exterior surface to the vehicle, and (c) a magnet attached to the bottom surface of the extension, the magnet being positioned and of a size and shape that a metal attracting surface of the magnet magnetically attaches to the exterior surface and urges the sealing against the exterior surface.

2. The device of claim 1 wherein the extension projects from the panel section in a direction away from the base portion.

3. The device of claim 1 wherein the frame member is annular in shape.

4. The device of claim 1 wherein the frame member is square in shape.

5. The device of claim 1 wherein the connecting section is made highly flexible by a reduced thickness.

6. The device of claim 1 wherein the molding is of a rubber composition.

7. The device of claim 6 wherein the molding is of a neoprene rubber composition.

8. The device of claim 1 wherein the adhesive means is a double sided contact adhesive composition.

9. A moisture and freeze protecting device to cover key lock opening devices proximate to an exterior surface of motor vehicles comprising:

(a) an integral molding of flexible polymeric material, the molding comprising:

(i) a base portion having a bottom surface opposed to the exterior surface of the motor vehicle, (ii) a flexible connecting section connected at one end and extending from the base portion toward the key lock opening, (iii) a panel section of a sufficient size and shape to cover the key lock opening device, the section being connected to a free end of the connecting section, (iv) a continuous frame member of a size and shape to surround the key lock opening device, the frame member depending from the panel section toward and terminating at a sealing surface abutting the exterior surface, the sealing surface being a sufficient height from the panel section that when the sealing surface abuts the exterior surface, the panel does not touch or barely touches the key opening device, and (v) an extension of the panel member parallel to the sealing surface, (b) an adhesive means adhesively attaching the bottom surface of the base portion to the exterior surface to the vehicle, and (c) a magnet attached to the extension of the panel member, the magnet being of a size and shape that a metal attracting surface of the magnet is alligna-ble with the sealing surface and pulls the sealing surface against the exterior surface.

10. The device of claim 9 wherein the extension projects from the panel section in a direction away from the base portion.

11. The device of claim 9 wherein the frame member is annular in shape.

12. The device of claim 9 wherein the frame member is square in shape.

13. The device of claim 9 wherein the connecting section is made highly flexible by a reduced thickness.

14. The device of claim 9 wherein the molding is of a rubber composition.

15. The device of claim 9 wherein the molding is of a neoprene rubber composition.

16. The device of claim 9 wherein the adhesive means is a double sided contact adhesive composition.

* * * * *